US011384482B2

(12) United States Patent
Inaba et al.

(10) Patent No.: US 11,384,482 B2
(45) Date of Patent: Jul. 12, 2022

(54) WEB MANUFACTURING APPARATUS AND SHEET MANUFACTURING APPARATUS

(71) Applicant: SEIKO EPSON CORPORATION, Tokyo (JP)

(72) Inventors: Isao Inaba, Suwa (JP); Masahide Nakamura, Matsumoto (JP); Kazuma Miyazawa, Shiojiri (JP); Yuki Oguchi, Okaya (JP); Isamu Arai, Tomi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 118 days.

(21) Appl. No.: 16/675,315

(22) Filed: Nov. 6, 2019

(65) Prior Publication Data

US 2020/0141059 A1 May 7, 2020

(30) Foreign Application Priority Data

Nov. 7, 2018 (JP) ..... JP2018-209382

(51) Int. Cl.
*D21G 7/00* (2006.01)
*D21F 7/00* (2006.01)
*D21G 9/00* (2006.01)

(52) U.S. Cl.
CPC ..... *D21G 7/00* (2013.01); *D21F 7/003* (2013.01); *D21G 9/0009* (2013.01)

(58) Field of Classification Search
CPC .. D21F 9/02; D21F 7/006; D21F 9/00; D21G 9/0018; D21G 9/00; D21G 9/009; D21G 9/0027; D21G 9/0054; D21B 1/063; D21H 23/20; D21H 17/33; B27N 3/26; B27N 3/04; D04H 1/732; D21C 9/1052; G05B 19/41865; G05B 13/021; G05B 19/418; G05B 2219/34418; G05B 23/022
See application file for complete search history.

(56) References Cited

U.S. PATENT DOCUMENTS 5,611,891 A * 3/1997 Hundley, III ..... D21F 1/08 162/198
6,092,001 A * 7/2000 Mizuno ..... G05B 19/41865 700/116
8,986,505 B2 * 3/2015 Oguchi ..... D21F 9/00 162/259
9,045,857 B2 * 6/2015 Gomi ..... D21B 1/068
(Continued)

FOREIGN PATENT DOCUMENTS

CN 110055785 B * 7/2021 ..... D21B 1/02
DE 102019102001 B4 * 9/2021 ..... B65H 3/042
(Continued)

*Primary Examiner* — Jose A Fortuna
(74) *Attorney, Agent, or Firm* — Oliff PLC

(57) ABSTRACT

A web manufacturing apparatus includes a transport section configured to transport a web containing fiber, a web humidifier configured to humidify the web, and a control section configured to control operation of the transport section and the web humidifier. When transportation of the web by the transport section is stopped, the control section causes the transport section to recommence transportation of the web after the web is humidified by the web humidifier. The control section may also cause the web humidifier to stop humidification of the web after the web humidifier starts humidification of the web and a predetermined duration elapses.

9 Claims, 5 Drawing Sheets

(56) References Cited

U.S. PATENT DOCUMENTS 9,463,579 B2 * 10/2016 Oguchi ..... D04H 1/732
9,498,896 B2 * 11/2016 Oguchi ..... D04H 1/732
9,574,304 B2 * 2/2017 Oguchi ..... D21B 1/063
9,637,860 B2 * 5/2017 Miyazawa ..... B27N 3/04
10,100,466 B2 * 10/2018 Gomi ..... D21B 1/10
10,145,046 B2 * 12/2018 Miyazawa ..... B32B 5/26
10,146,217 B2 * 12/2018 Pauly ..... G06F 16/9535
10,350,784 B2 * 7/2019 Murayama ..... B27N 3/002
10,563,351 B2 * 2/2020 Murayama ..... D21B 1/06
10,619,302 B2 * 4/2020 Gomi ..... D21F 9/00
10,647,020 B2 * 5/2020 Oguchi ..... B07B 9/02
10,647,022 B2 * 5/2020 Nagai ..... B27N 3/12
10,895,869 B2 * 1/2021 Taniguchi ..... G05B 19/418
11,001,970 B2 * 5/2021 Taniguchi ..... D04H 1/732
11,005,133 B2 * 5/2021 Oguchi ..... D21F 9/00
11,008,707 B2 * 5/2021 Yoda ..... D21F 7/00
11,028,536 B2 * 6/2021 Miyasaka ..... D21D 1/02
11,060,242 B2 * 7/2021 Abe ..... D21F 9/00
11,313,078 B2 * 4/2022 Oguchi ..... B27N 3/04
2002/0104635 A1 * 8/2002 Wells ..... G01N 21/8921 162/198
2002/0177909 A1 * 11/2002 Fu ..... G05B 17/02 700/28
2003/0216828 A1 * 11/2003 Puurtinen ..... D21F 9/003 700/128
2004/0238140 A1 * 12/2004 Laitinen-Vellonen .... D21F 1/66 162/198
2008/0140439 A1 * 6/2008 Hoffman ..... G06Q 30/0206 705/317
2009/0106290 A1 * 4/2009 Rivard ..... G05B 23/0229
2009/0185162 A1 * 7/2009 Shakespeare ..... G01N 21/33 356/51
2014/0110871 A1 * 4/2014 Backstrom ..... D21G 9/0027 264/40.1
2014/0290884 A1 * 10/2014 Yamagami ..... D21G 9/0018 162/158
2014/0290887 A1 * 10/2014 Gomi ..... D21B 1/068 162/252
2014/0290889 A1 * 10/2014 Oguchi ..... D21B 1/08 162/259
2015/0096705 A1 * 4/2015 Fujita ..... D04H 1/00 162/348
2015/0176204 A1 * 6/2015 Miyazawa ..... D21F 9/00 162/263
2015/0184341 A1 * 7/2015 Tanaka ..... D04H 1/736 162/252
2015/0204015 A1 * 7/2015 Gomi ..... B29C 35/0277 162/261
2015/0240418 A1 * 8/2015 Oguchi ..... D21G 9/0009 162/109
2015/0240422 A1 * 8/2015 Oguchi ..... D21D 5/24 162/202
2015/0247286 A1 * 9/2015 Nagai ..... D21F 9/00 162/261
2015/0251867 A1 * 9/2015 Higuchi ..... B65H 20/10 226/95
2015/0252530 A1 * 9/2015 Higuchi ..... D21F 1/526 162/363
2015/0275429 A1 * 10/2015 Higuchi ..... D21F 11/00 162/261
2015/0275430 A1 * 10/2015 Higuchi ..... D21F 9/04 162/261
2015/0275435 A1 * 10/2015 Seki ..... D21H 17/20 162/5
2015/0292153 A1 * 10/2015 Miyazawa ..... B27N 3/04 162/261
2016/0053435 A1 * 2/2016 Oguchi ..... D21B 1/063 162/198
2016/0121564 A1 * 5/2016 Oguchi ..... D04H 1/732 264/40.4
2016/0168794 A1 * 6/2016 Tsujino ..... D21F 11/00 162/198
2016/0168795 A1 * 6/2016 Fujita ..... D21F 9/00 162/261
2016/0186379 A1 * 6/2016 Hirata ..... D21B 1/08 162/202
2016/0229129 A1 * 8/2016 Ueno ..... B29B 7/38
2016/0230338 A1 * 8/2016 Nakamura ..... B07B 13/16
2016/0236380 A1 * 8/2016 Fujita ..... D21F 9/00
2016/0258112 A1 * 9/2016 Gomi ..... D21B 1/10
2016/0305066 A1 * 10/2016 Miyazawa ..... D04H 1/26
2016/0312405 A1 * 10/2016 Murayama ..... D21B 1/10
2016/0332325 A1 * 11/2016 Murayama ..... B27N 3/04
2017/0037550 A1 * 2/2017 Miyazawa ..... D04H 1/26
2017/0260691 A1 * 9/2017 Murayama ..... B65H 5/24
2017/0300042 A1 * 10/2017 Pauly ..... G06F 16/9535
2017/0312996 A1 * 11/2017 Murayama ..... D21B 1/08
2018/0314215 A9 * 11/2018 Sangi ..... G05B 13/021
2018/0319038 A1 * 11/2018 Nagai ..... B27N 1/029
2018/0347115 A1 * 12/2018 Oguchi ..... D04H 1/60
2018/0355556 A1 * 12/2018 Gomi ..... D21B 1/063
2018/0356805 A1 * 12/2018 Krishna ..... G05B 19/0428
2019/0062996 A1 * 2/2019 Yoda ..... D21F 9/046
2019/0100877 A1 * 4/2019 Oguchi ..... D21F 9/00
2019/0193296 A1 * 6/2019 Mikoshiba ..... D04H 1/413
2019/0218713 A1 * 7/2019 Oguchi ..... D21D 5/06
2019/0218714 A1 * 7/2019 Oguchi ..... D21G 9/0027
2019/0264393 A1 * 8/2019 Taniguchi ..... D04H 1/60
2019/0270220 A1 * 9/2019 Oguchi ..... D04H 1/60
2019/0309475 A1 * 10/2019 Inagaki ..... F24F 3/14
2020/0101637 A1 * 4/2020 Yoda ..... D04H 1/732
2020/0140217 A1 * 5/2020 Fukasawa ..... B65H 35/008
2020/0141059 A1 * 5/2020 Inaba ..... D21G 9/0009
2020/0149219 A1 * 5/2020 Nakata ..... D21B 1/10
2020/0206668 A1 * 7/2020 Miyazawa ..... B01D 45/14
2020/0208348 A1 * 7/2020 Yamada ..... D21F 7/006
2021/0047779 A1 * 2/2021 Oguchi ..... D21F 13/00

FOREIGN PATENT DOCUMENTS

EP 1767690 A2 * 3/2007 ..... D21G 9/0018
EP 3508634 A1 * 7/2019 ..... D21F 9/00
EP 3508635 A1 * 7/2019 ..... D04H 1/732
EP 3543615 A1 * 9/2019 ..... F24F 6/00
JP H08-503255 A 4/1996
JP 2002333275 A * 11/2002
JP 2012140738 A * 7/2012 ..... D21F 7/06
JP 6573036 B2 * 9/2019 ..... B27N 3/04
JP 202076168 A * 5/2020 ..... D21F 9/00
JP 2020076168 A * 5/2020 ..... D21F 7/003
JP 6787403 B2 * 11/2020 ..... G06F 3/0481
WO WO-2017094514 A1 * 6/2017 ..... D21G 9/0009

* cited by examiner

WEB MANUFACTURING APPARATUS AND SHEET MANUFACTURING APPARATUS

The present application is based on, and claims priority from JP Application Serial Number 2018-209382, filed Nov. 7, 2018, the disclosure of which is hereby incorporated by reference herein in its entirety.

BACKGROUND

1. Technical Field

The present disclosure relates to a web manufacturing apparatus and a sheet manufacturing apparatus.

2. Related Art

JP-T-8-503255 discloses a method for manufacturing a shaped article from a mixture of fibrous material and binder powder. In this method, first, fibers are spread out in a sheet shape and mechanically and preliminarily consolidated to obtain a sheet-shaped fibrous structure. Next, the binder powder is distributed in the obtained sheet-shaped fibrous structure. Water is distributed to moisten the sheet-shaped fibrous structure in which the binder powder is distributed, at 5% by weight to 60% by weight of water as a percentage of the overall dry weight of the fiber and binder mixture. The moistened sheet-shaped fibrous structure is then subjected to pressing and heat treatment to obtain the shaped article.

In the method disclosed in JP-T-8-503255, it is conceivable that a series of processes are consecutively performed by transporting the sheet-shaped fibrous structure in sequence to areas where these respective processes are performed.

However, the processes may be intentionally or unintentionally stopped at a stage when the moistened sheet-shaped fibrous structure has not yet been transported to an area where pressing and heat treatment are performed. In such cases, the moistened sheet-shaped fibrous structure is left waiting as it is, and drying may proceed over time depending on environmental conditions. If this occurs, there is a concern of deterioration of the mechanical properties of the sheet-shaped fibrous structure.

When the processes then recommence in a state in which drying is proceeding, the sheet-shaped fibrous structure may be transported in a state in which its mechanical properties have deteriorated. There is accordingly a concern of creases occurring in the sheet-shaped fibrous structure, or the thickness of the sheet-shaped fibrous structure becoming inconsistent during transportation.

SUMMARY

The present disclosure addresses the above issues, and may be realized in the following manner.

According to an aspect of the present disclosure, a web manufacturing apparatus includes a transport section configured to transport a web containing fiber, a web humidifier configured to humidify the web, and a control section configured to control operation of the transport section and the web humidifier. When transportation of the web by the transport section is stopped, the control section causes the transport section to recommence transportation of the web after the web is humidified by the web humidifier.

According to another aspect of the present disclosure, a sheet manufacturing apparatus configured to manufacture a sheet from a web which is pressed includes the web manufacturing apparatus of the present disclosure, and a press section configured to press the web manufactured by the web manufacturing apparatus.

DESCRIPTION OF EXEMPLARY EMBODIMENTS

A detailed explanation of a web manufacturing apparatus and a sheet manufacturing apparatus of the present disclosure is given below based on preferable embodiments as illustrated in the accompanying drawings.

First Embodiment

First, explanation follows regarding a web manufacturing apparatus and a sheet manufacturing apparatus according to a first embodiment.

Figure 1:
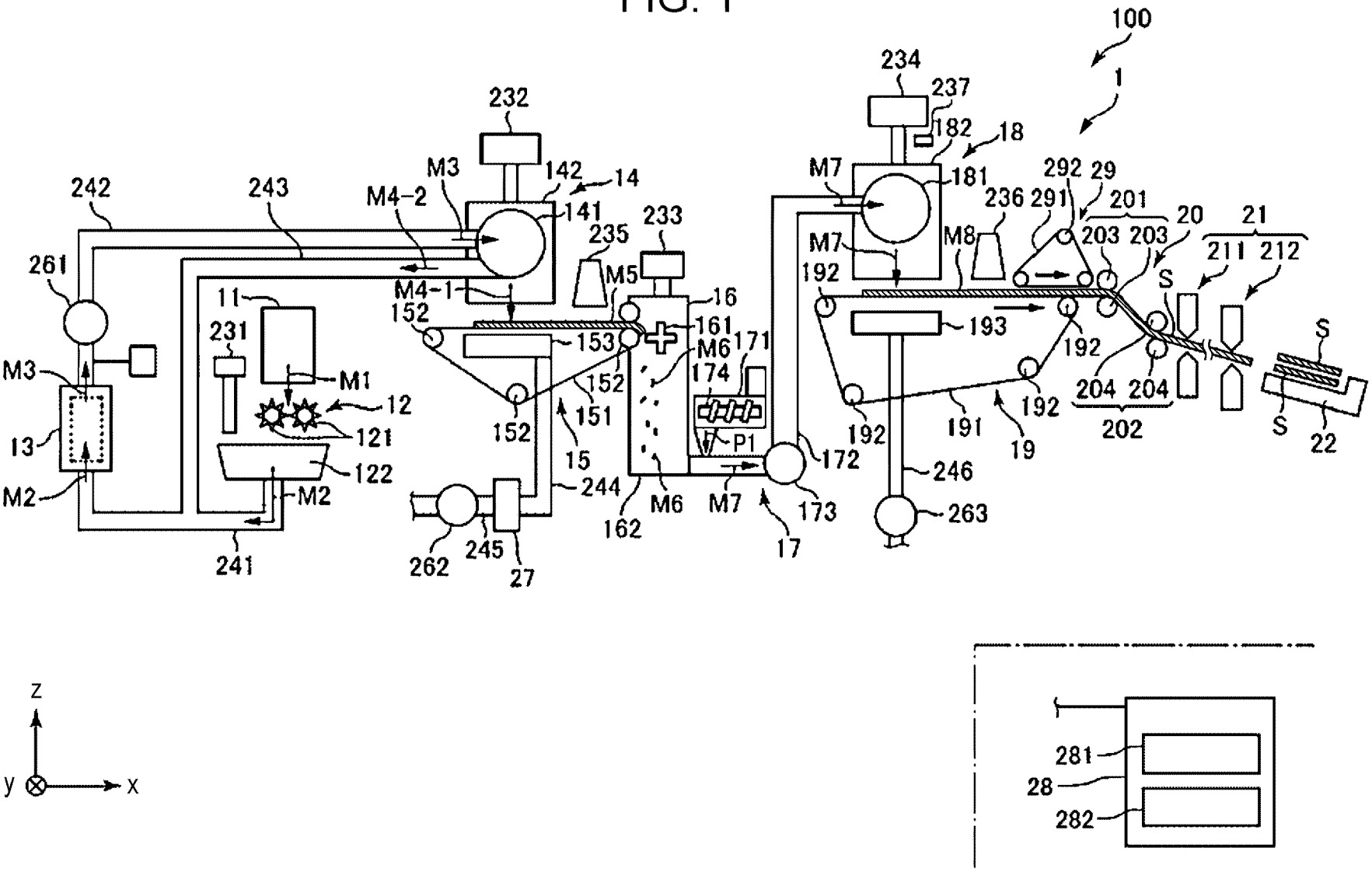
FIG. 1 is a schematic side view illustrating a sheet manufacturing apparatus according to a first embodiment.
Figure 2:
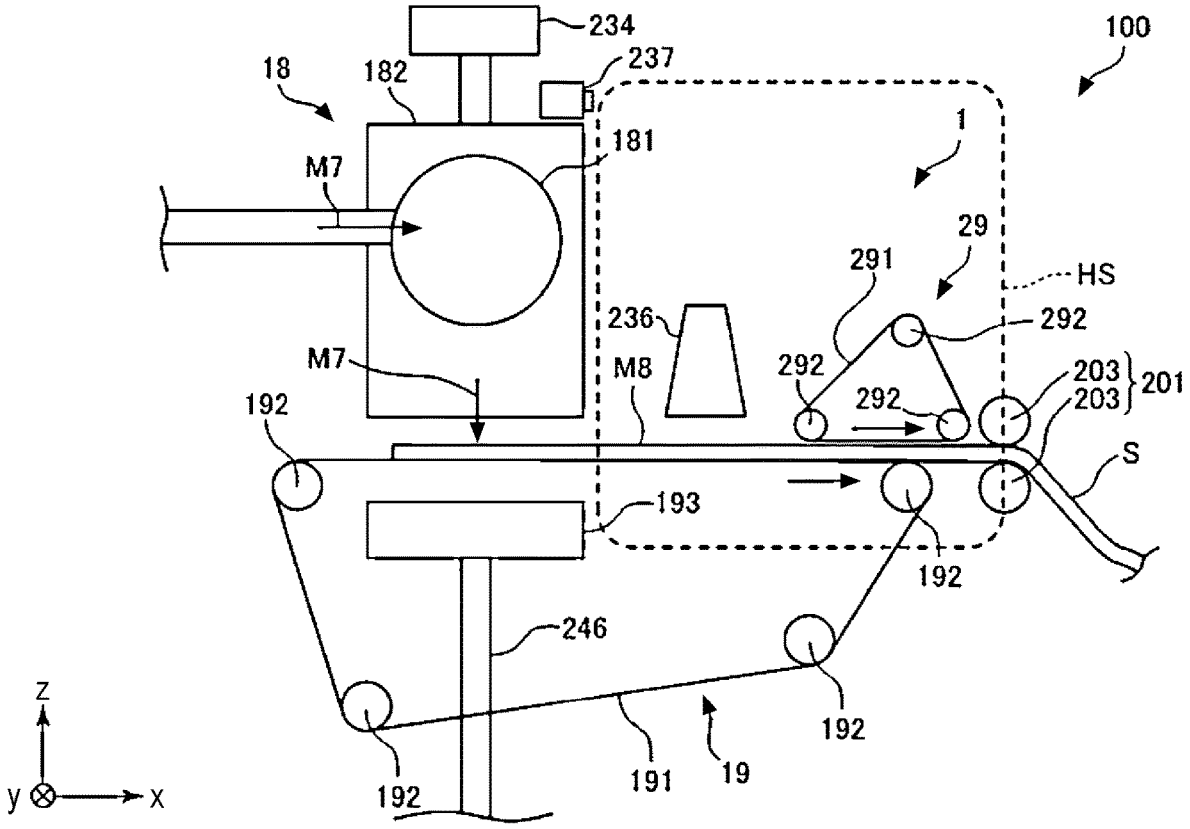
FIG. 2 is an enlarged view corresponding to part of FIG. 1.
Figure 3:
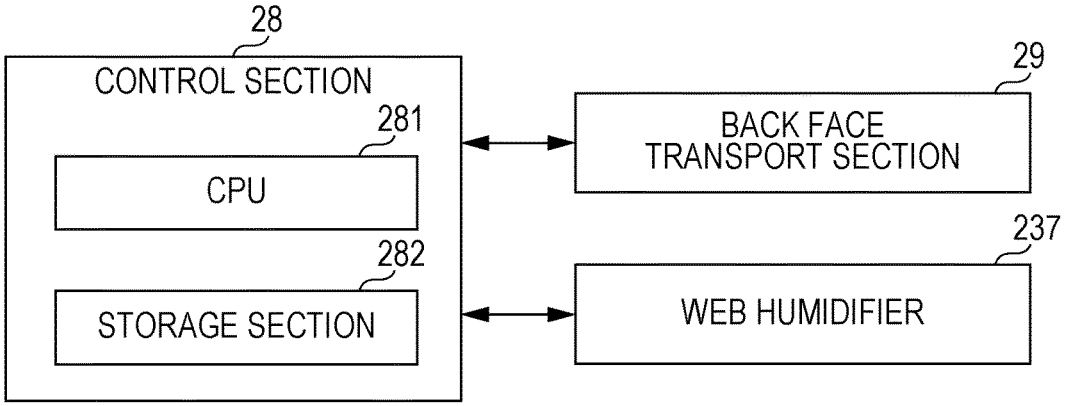
FIG. 3 is a block diagram of a web manufacturing apparatus illustrated in FIG. 1.

FIG. 1 is a schematic side view illustrating the sheet manufacturing apparatus according to the first embodiment. FIG. 2 is an enlarged view corresponding to part of FIG. 1. FIG. 3 is a block diagram of a web manufacturing apparatus illustrated in FIG. 1.

For ease of explanation, three mutually orthogonal axes illustrated in FIG. 1 will be referred to as an x-axis, a y-axis, and a z-axis. The xy-plane including the x-axis and the y-axis is horizontal, and the z-axis is vertical. The direction indicated by the arrow on each of the axes is referred to as "+", and the opposite direction thereto is referred to as "−". The top side of FIG. 1 is sometimes referred to as upper or upward, and the bottom side thereof is sometimes referred to as lower or downward. The left side of FIG. 2 is sometimes referred to as being "upstream" and the right side thereof is sometimes referred to as being "downstream".

As illustrated in FIG. 1, a sheet manufacturing apparatus 100 includes a web manufacturing apparatus 1, a sheet forming section 20, a cutting section 21, a stacking section 22, and a collection section 27.

The web manufacturing apparatus 1 includes a feedstock supply section 11, a crushing section 12, a defibration section 13, a sorting section 14, a first web forming section 15, a shredding section 16, a mixer 17, a disentangling section 18, a second web forming section 19, a control section 28, a back face transport section 29, and a web humidifier 237. Each of the sections configuring the web manufacturing apparatus 1 is electrically coupled to the control section 28, and the respective operations thereof are controlled by the control section 28.

The sheet manufacturing apparatus 100 also includes a humidifier 231, a humidifier 232, a humidifier 233, a humidifier 234, a humidifier 235, and a humidifier 236. The sheet manufacturing apparatus 100 also includes a blower 261, a blower 262, and a blower 263.

The sheet manufacturing apparatus 100 executes the following processes in sequence: a feedstock supply process, a crushing process, a defibration process, a sorting process, a first web forming process, a dividing process, a mixing process, a disentangling process, a second web forming process, a sheet forming process, and a cutting process.

Explanation follows regarding the configuration of each of these sections.

The feedstock supply section 11 is the section where the feedstock supply process is performed, in which a feedstock M1 is supplied into the crushing section 12. Examples of the feedstock M1 include sheet-form materials made from fiber-containing materials that include cellulose fibers. Cellulose fibers are any material formed into a fibrous shape that has cellulose, namely cellulose in the narrow sense, as the main component compound thereof. The cellulose fibers may include hemicellulose, lignin, or the like in addition to cellulose in the narrow sense. There is no particular limitation to the form of the feedstock M1, which may be woven, non-woven, or the like. The feedstock M1 may, for example, be recycled-paper manufactured by defibrating and reusing old paper, or synthetic paper such as YUPO paper (registered trademark). The feedstock M1 is not necessarily recycled paper. The feedstock M1 in the present embodiment is old paper that may be either previously used or scrap.

The crushing section 12 is the section where the crushing process is performed, in which the feedstock M1 supplied from the feedstock supply section 11 is crushed in air, such as in atmospheric air. The crushing section 12 includes a pair of crushing blades 121, and a chute 122.

The pair of crushing blades 121 rotate in opposite directions to each other so as to crush the feedstock M1 between the blades, i.e. so as to be able to cut the feedstock M1 into coarse fragments M2. The shape and size of the coarse fragments M2 are preferably tailored to the defibration process in the defibration section 13 and are, for example, preferably small fragments with a side length of not more than 100 mm, and more preferably small fragments with a side length from 10 mm to 70 mm.

The chute 122 is disposed below the pair of crushing blades 121 and is, for example, configured with a funnel shape. The chute 122 is thereby able to receive falling coarse fragments M2 that have been crushed by the crushing blades 121.

The humidifier 231 is disposed above the chute 122 and alongside the pair of crushing blades 121. The humidifier 231 humidifies the coarse fragments M2 inside the chute 122. The humidifier 231 is configured by a vaporizing humidifier device, or by a warm air vaporizing humidifier device, that includes a moist non-illustrated filter and that feeds humidified air of raised humidity into the coarse fragments M2 by passing air through the filter. Feeding the humidified air into the coarse fragments M2 enables the coarse fragments M2 to be suppressed from adhering with static electricity to the chute 122 or the like.

The chute 122 is coupled to the defibration section 13 by a pipe 241. The coarse fragments M2 collected in the chute 122 are fed out through the pipe 241 to the defibration section 13.

The defibration section 13 is the section that performs the defibration process on the coarse fragments M2 in air, namely performs dry defibration. A defibrated material M3 can be generated from the coarse fragments M2 by performing the defibration process in the defibration section 13. "Defibration" as referred to here means taking the coarse fragments M2 configured from plural fibers bound together, and disentangling the fibers into individual fibers. The disentangled product is what is referred to as the defibrated material M3. The defibrated material M3 may be in the form of lines or strips. There may still be defibrated material M3 present that is somewhat intertwined in agglomerations, formed into what is referred to as "clumps".

The defibration section 13 of the present embodiment is, for example, configured by an impeller mill including a high speed rotor and a liner positioned around the outer periphery of the rotor. The coarse fragments M2 flowing into the defibration section 13 are squeezed between the rotor and the liner and defibrated thereby.

The defibration section 13 is able to generate a flow of air, i.e. an airflow, from the crushing section 12 toward the sorting section 14 by rotation of the rotor. This enables the coarse fragments M2 to be sucked into the defibration section 13 through the pipe 241. After the defibration process, the defibrated material M3 can then be sent on toward the sorting section 14 through a pipe 242.

The blower 261 is installed partway along the pipe 242. The blower 261 is an airflow generating device for generating an airflow toward the sorting section 14. This promotes transportation of the defibrated material M3 toward the sorting section 14.

The sorting section 14 is the section where the sorting process is performed, in which the defibrated material M3 is sorted into long and short fibers. The defibrated material M3 is sorted in the sorting section 14 into a first sorting M4-1, and a second sorting M4-2 larger than the first sorting M4-1. The first sorting M4-1 is for fibers of a length suitable for manufacturing a sheet S at a later stage. The average length in the first sorting M4-1 is preferably from 1 μm to 30 μm. The second sorting M4-2 includes, for example, insufficiently defibrated fibers, defibrated fibers that have aggregated together excessively, etc.

The sorting section 14 includes a drum 141, and a housing 142 housing the drum 141.

The drum 141 is configured by a cylindrical mesh, and is a sieve that rotates about its own central axis. The defibrated material M3 flows into the drum 141. Rotation of the drum 141 sorts defibrated material M3 smaller than the size of the mesh into the first sorting M4-1, and sorts defibrated material M3 equal to or larger than the mesh size into the second sorting M4-2.

The first sorting M4-1 falls through the drum 141.

The second sorting M4-2 is fed out into a pipe 243 coupled to the drum 141. The opposite end of the pipe 243 to the drum 141, namely an downstream end thereof, is coupled to the pipe 241. The second sorting M4-2 that has passed through the pipe 243 merges with the coarse fragments M2 inside the pipe 241, and flows back into the defibration section 13 together with the coarse fragments M2. The second sorting M4-2 is thereby returned to the defibration section 13, and is again subjected to the defibration process together with the coarse fragments M2.

The first sorting M4-1 from the drum 141 falls while being dispersed in the air, and falls toward the first web forming section 15 positioned below the drum 141. The first web forming section 15 is the section where the first web forming process is performed, in which a first web M5 is formed from the first sorting M4-1. The first web forming section 15 includes a mesh belt 151, three tension rollers 152, and a suction section 153.

The mesh belt 151 is an endless belt for the first sorting M4-1 to accumulate on. The mesh belt 151 is entrained around the three tension rollers 152. The first sorting M4-1 lying on the mesh belt 151 is transported downstream by rotational driving of the tension rollers 152.

The first sorting M4-1 is configured by fibers equal to or larger than the mesh size of the mesh belt 151. The first sorting M4-1 is thereby restricted from passing through the mesh belt 151, and can accordingly be accumulated on the mesh belt 151. The first sorting M4-1 is formed into a layer as the first web M5 by accumulating on the mesh belt 151 while being transported downstream along with the mesh belt 151.

There is a concern that there might, for example, be dirt and dust etc. mixed in with the first sorting M4-1. The dirt and dust is, for example, generated by the crushing and defibration. Such dirt and dust is collected in the collection section 27, described later.

The suction section 153 is a suction mechanism that suctions air downwards from the mesh belt 151. The dirt and dust that has passed through the mesh belt 151 can thereby be suctioned along with the air.

The suction section 153 is coupled through a pipe 244 to the collection section 27. The dirt and dust suctioned by the suction section 153 are collected in the collection section 27.

A pipe 245 is also coupled to the collection section 27. A blower 262 is installed partway along the pipe 245. This enables a suction force to be generated at the suction section 153 by operation of the blower 262. The formation of the first web M5 on the mesh belt 151 is promoted thereby. The first web M5 has had the dirt and dust etc. removed therefrom.

The housing 142 is coupled to the humidifier 232. The humidifier 232 is configured by a vaporizing humidifier device similar to the humidifier 231. Humidified air is thereby fed into the housing 142. The first sorting M4-1 can be humidified by the humidified air, enabling the first sorting M4-1 to be suppressed from adhering with static electricity to the inside walls of the housing 142.

The humidifier 235 is disposed downstream of the sorting section 14. The humidifier 235 is configured by an ultrasonic humidifier device that creates a mist of water. This enables moisture to be supplied to the first web M5, thereby adjusting the moisture content of the first web M5. Such adjustment enables the first web M5 to be suppressed from adhering with static electricity to the mesh belt 151. The first web M5 is thereby readily separated from the mesh belt 151 at the position where the mesh belt 151 returns on itself around one of the tension rollers 152.

The shredding section 16 is disposed downstream of the humidifier 235. The shredding section 16 is the section where the dividing process is performed, in which the first web M5 that has separated from the mesh belt 151 is divided. The shredding section 16 includes a rotatably supported propeller 161 and a housing 162 housing the propeller 161. The first web M5 can be divided by the rotating propeller 161. The first web M5 when divided becomes shreddings M6. The shreddings M6 fall inside the housing 162.

The housing 162 is coupled to the humidifier 233. The humidifier 233 is configured by a vaporizing humidifier device similar to the humidifier 231. Humidified air is thereby fed into the housing 162. The humidified air enables the shreddings M6 to be suppressed from adhering with static electricity to the propeller 161 and the inside walls of the housing 162.

The mixer 17 is disposed downstream of the shredding section 16. The mixer 17 is the section where the mixing process is performed, in which the shreddings M6 and a resin P1 are mixed together. The mixer 17 includes a resin feeder 171, a pipe 172, and a blower 173.

The pipe 172 couples the housing 162 of the shredding section 16 and a housing 182 of the disentangling section 18 together, and is a flow path for a mixed material M7, a mixture of the shreddings M6 and the resin P1, to pass through.

The resin feeder 171 is coupled partway along the pipe 172. The resin feeder 171 includes a screw feeder 174. The resin P1 can be fed into the pipe 172 as a powder or as granules by rotational driving of the screw feeder 174. The resin P1 fed into the pipe 172 is mixed with the shreddings M6 to form the mixed material M7.

Note that the resin P1 is employed to bind fibers together in a later process and although it may, for example, be a thermoplastic resin or curable resin, a thermoplastic resin is preferably employed therefor. Examples of such thermoplastic resins include: AS resins; ABS resins; polyolefins and modified polyolefins such as such as polyethylene, polypropylene, ethylene-vinyl acetate copolymer (EVA) and the like; acrylic resins such as poly (methyl methacrylate); polyesters such as poly vinyl chloride, polystyrene, polyethylene terephthalate, polybutylene terephthalate and the like; polyamides such as NYLON 6, NYLON 46, NYLON 66, NYLON 610, NYLON 612, NYLON 11, NYLON 12, NYLON 6-12, NYLON 6-66 and the like; polyphenylene ethers; polyacetals; polyethers; polyphenylene oxides; polyether ether ketones; polycarbonates; polyphenylene sulfides; thermoplastic polyimides; polyether imides; liquid crystal polymers such as aromatic polyesters; and various types of thermoplastic elastomer such as styrene-based, polyolefin-based, polyvinyl chloride-based, polyurethane-based, polyester-based, polyamide-based, polybutadiene-based, transpolyisoprene-based, fluorine rubber-based, or chlorinated polyethylene-based thermoplastic elastomers. One resin selected from the above resins may be employed as the thermoplastic resin alone, or two or more resins selected therefrom may be employed in combination. A polyester resin or a resin including polyester is preferably employed as the thermoplastic resin.

In addition to the resin P1, other substances may also be fed out from the resin feeder 171. These include a colorant to color the fibers, an anti-caking agent to suppress aggregation of the fibers and aggregation of the resin P1, a fire retardant to render the fibers etc. less liable to combust, and a paper strengthening agent to increase the paper strength of the sheet S. Alternatively these other substances may be compounded with the resin P1 in advance before then being fed out from the resin feeder 171.

The blower 173 is installed partway along the pipe 172 at a position downstream of the resin feeder 171. The shreddings M6 and the resin P1 are mixed together by the action of a rotating section such as fan blades of the blower 173. The blower 173 is capable of generating an airflow toward the disentangling section 18. The shreddings M6 and the resin P1 can be stirred inside the pipe 172 by this airflow. The mixed material M7 can accordingly be introduced into the disentangling section 18 in a state in which the shreddings M6 and the resin P1 have been uniformly dispersed. The shreddings M6 in the mixed material M7 are disentangled by the process of passing through the inside of the pipe 172 so as to result in a finer fibrous form.

The disentangling section 18 is the section where the disentangling process is performed to disentangle the intertwined fibers in the mixed material M7 from each other. The disentangling section 18 includes a drum 181 and the housing 182 housing the drum 181.

The drum 181 is configured by a cylindrical mesh, and is a sieve that rotates about its own central axis. The mixed material M7 flows into the drum 181. Rotation of the drum 181 enables the fibers and the like in mixed material M7 smaller than the size of the mesh to pass through the drum 181. The mixed material M7 is disentangled by this action.

The housing 182 is coupled to the humidifier 234. The humidifier 234 is configured by a vaporizing humidifier device similar to the humidifier 231. Humidified air is thereby fed into the housing 182. The inside of the housing 182 can be humidified by the humidified air, enabling the mixed material M7 to be suppressed from adhering with static electricity to the inside walls of the housing 182.

The mixed material M7 disentangled by the drum 181 is dispersed in the air while falling toward the second web forming section 19 positioned below the drum 181. The second web forming section 19 is the section where the second web forming process is performed to form a second web M8 from the mixed material M7. The second web forming section 19 includes a mesh belt 191, tension rollers 192, and a suction section 193.

The mesh belt 191 is an endless belt for the mixed material M7 to accumulate on. The mesh belt 191 is entrained around the four tension rollers 192. The mixed material M7 on the mesh belt 191 is transported downstream by rotational driving of the tension rollers 192.

Almost all of the mixed material M7 on the mesh belt 191 is the size of the mesh of the mesh belt 191 or larger. This enables the mixed material M7 to be restricted from passing through the mesh belt 191, and thereby enables the mixed material M7 to be accumulated on the mesh belt 191. The mixed material M7 is formed into a layer as the second web M8 by accumulating on the mesh belt 191 while being transported downstream along with the mesh belt 191.

The suction section 193 is a suction mechanism that suctions air downwards from the mesh belt 191. This enables the mixed material M7 on the mesh belt 191 to be suctioned, thereby promoting accumulation of the mixed material M7 on the mesh belt 191.

A pipe 246 is coupled to the suction section 193. The blower 263 is installed partway along the pipe 246. A suction force can be generated at the suction section 193 by operation of the blower 263.

The humidifier 236 is disposed downstream of the disentangling section 18. The humidifier 236 is configured by an ultrasonic humidifier device similar to the humidifier 235. This enables moisture to be supplied to the second web M8, thereby adjusting the moisture content of the second web M8. Such adjustment enables the second web M8 to be suppressed from adhering with static electricity to the mesh belt 191. The second web M8 is thereby readily separated from the mesh belt 191 at the position where the mesh belt 191 returns on itself around one of the tension rollers 192. Note that humidifier 236 is not limited to being an ultrasonic humidifier device, and may be a vaporizing humidifier device.

The total moisture content added by the humidifier 231 to the humidifier 236 is, for example, preferably from 0.5 parts by mass to 20 parts by mass with respect to 100 parts by mass of material prior to humidification.

The back face transport section 29, described later, is disposed downstream of the second web forming section 19, and the sheet forming section 20 is further disposed downstream of the back face transport section 29. The sheet forming section 20 is the section where the sheet forming process is performed to form the sheet S from the second web M8. The sheet forming section 20 includes the press section 201 and a heating section 202.

The press section 201 includes a pair of calender rollers 203. The second web M8 can be pressed between the calender rollers 203 without being heated. The density of the second web M8 is raised thereby. The level of heating at this point is, for example, preferably a level of heating that will not melt the resin P1. The second web M8 is then transported toward the heating section 202. One of the pair of calender rollers 203 is a lead roller driven by operation of a non-illustrated motor, and the other is a following roller.

The heating section 202 includes a pair of heating rollers 204. The second web M8 can be pressed between the heating rollers 204 while being heated. The resin P1 is melted by the heating and pressing, and the fibers in the second web M8 are bonded together by the molten resin P1. The sheet S is formed thereby. The sheet S is then transported toward the cutting section 21. Note that one of the pair of heating rollers 204 is a lead roller driven by operation of a non-illustrated motor, and the other is a following roller.

The cutting section 21 is disposed downstream of the sheet forming section 20. The cutting section 21 is the section where the cutting process is performed to cut the sheet S. The cutting section 21 includes first cutters 211 and second cutters 212.

The first cutters 211 cut the sheet S along a direction intersecting with the transport direction of the sheet S, and in particular a direction orthogonal thereto.

The second cutters 212 cut the sheet S in a direction parallel to the transport direction of the sheet S downstream of the first cutters 211. This cutting removes unwanted portions at the two end portions of the sheet S (end portions in the y axis direction), so as to fix the width of the sheet S. The portions removed by this cutting are called "offcuts".

A sheet S of the desired shape and size is obtained by this cutting by the first cutters 211 and the second cutters 212. Each sheet S is then transported further downstream and stacked in the stacking section 22.

The back face transport section 29 is a transport section that transports the second web M8 in the downstream direction. The back face transport section 29 includes a mesh belt 291 and plural tension rollers 292. The mesh belt 291 is an endless belt that is entrained around the three tension rollers 292. The second web M8 lying under the mesh belt 291 is transported downstream by rotational driving of the tension rollers 292. The back face transport section 29 is disposed above the mesh belt 191 described previously. Part of an extension range of the mesh belt 291 overlaps an extension range of the mesh belt 191 described previously. The second web M8 is inserted through this overlapping part. Thus, an upper face of the second web M8 abuts the mesh belt 291, and a lower face of the second web M8 abuts the mesh belt 191. The second web M8 is thereby held between the mesh belt 291 and the mesh belt 191 from above and below so as to be more stably transported.

If required, the back face transport section 29 may include a sensor or the like to detect whether or not the second web M8 is present below the mesh belt 291. A detection signal from the sensor is output to the control section 28.

Note that since the second web M8 is humidified by the humidifier 236, the second web M8 has a sufficient moisture content while the sheet manufacturing apparatus 100 is running. Thus, the second web M8 also has good mechanical properties, and there is no impediment to transportation by the back face transport section 29.

However, the sheet manufacturing apparatus 100 sometimes stops running, either intentionally or unintentionally. When this occurs, depending on the operational status of the sheet manufacturing apparatus 100 the second web M8 may remain directly under the back face transport section 29. When the sheet manufacturing apparatus 100 stops running, both transportation of the second web M8 and humidification of the second web M8 by the humidifier 236 also stop, such that there is a possibility of the moisture contained in the second web M8 gradually evaporating, causing the moisture content of the second web M8 to drop over time. This tendency is particularly marked when the environment around the sheet manufacturing apparatus 100 is dry.

When the sheet manufacturing apparatus 100 starts running again after having stopped, the back face transport section 29 also starts running again, and downstream transportation of the second web M8 remaining under the back face transport section 29 recommences. However, when the moisture content of the second web M8 that has remained under the back face transport section 29 drops while the sheet manufacturing apparatus 100 is stopped, there is a possibility of deterioration to the mechanical properties of the second web M8 as a result. In such cases, there is a concern that creases might occur in the second web M8 or the thickness of the second web M8 might become inconsistent as a result of transportation by the back face transport section 29.

To address this, the web manufacturing apparatus 1 according to the present embodiment includes a web humidifier 237 capable of humidifying the second web M8. The web humidifier 237 humidifies the second web M8 prior to transportation recommencing after transportation of the second web M8 has stopped. As illustrated in FIG. 1, the web humidifier 237 is provided above the drum 181, and humidifies the back face transport section 29 and its surroundings, i.e. a space HS in which the second web M8 is being transported. By humidifying the space HS, the second web M8 is also humidified and its moisture content is raised. Note that when the mesh belt 291 allows air to pass through, the second web M8 can also be humidified through the mesh belt 291.

Transportation by the back face transport section 29 recommences after the second web M8 has been humidified by the web humidifier 237. In this manner, the second web M8 is transported in a state in which sufficient mechanical properties are ensured, thereby suppressing a reduction in quality such as that described above.

Note that the space HS refers to a range that the web humidifier 237 is capable of humidifying, and may be an enclosed space surrounded by external panels, equipment, or the like, or may be an open space open to the exterior.

As illustrated in FIG. 3, the control section 28 includes a central processing unit (CPU) 281, and a storage section 282. The above-described operation of the web manufacturing apparatus 1 is controlled by the control section 28. Namely, operation of the back face transport section 29 and the web humidifier 237 is controlled based on control signals from the control section 28.

Note that the position of the web humidifier 237 is not limited to the above-described position, and may be any position as long as it is capable of humidifying the space HS.

Figure 4:
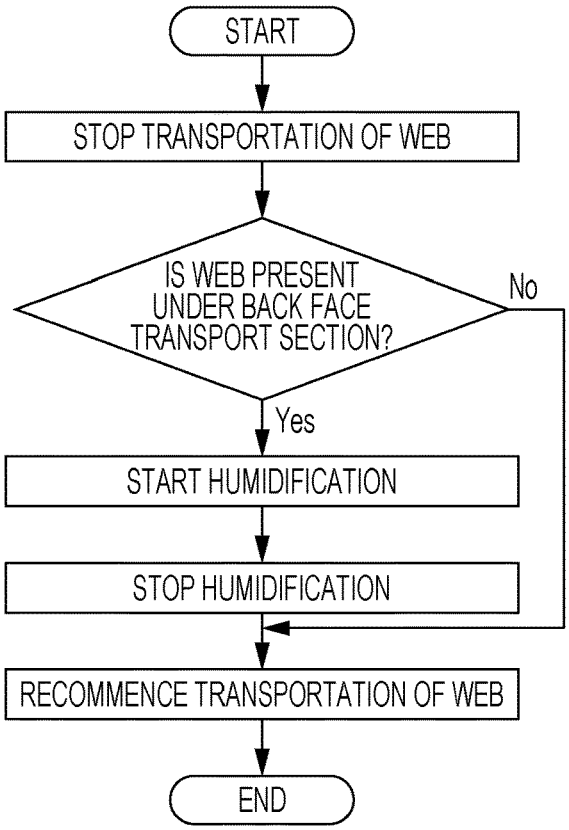
FIG. 4 is a flowchart illustrating operation of the web manufacturing apparatus illustrated in FIG. 1.

FIG. 4 is a flowchart illustrating operation of the web manufacturing apparatus illustrated in FIG. 1.

As previously described, sometimes manufacture of the second web M8 by the web manufacturing apparatus 1 stops, either intentionally or unintentionally. For example, transportation of the second web M8 may stop unintentionally due to a power cut or the like, or transportation may be stopped intentionally. When transportation of the second web M8 is stopped in such a manner, the control section 28 stores information, for example the time of stopping and the presence or absence of the second web M8, in the storage section 282 as required. Prior to transportation of the second web M8 recommencing, the control section 28 determines whether or not the second web M8 is present under the back face transport section 29 based on the information stored in the storage section 282, or based on a signal from the back face transport section 29. Note that the information on which this determination is based is not limited to the above-described information.

When the second web M8 is not present under the back face transport section 29, the control section 28 recommences transportation of the second web M8. When the second web M8 is present under the back face transport section 29, the control section 28 starts humidification of the second web M8 by the web humidifier 237.

The humidification amount by the web humidifier 237 when this is performed should raise the moisture content of the second web M8 sufficiently to ensure that the required mechanical properties are satisfied. For example, the control section 28 according to the present embodiment performs control so as to start humidification of the second web M8 by the web humidifier 237, and then stop humidification of the second web M8 after a predetermined duration has elapsed. Using a preset duration to control the humidification amount in this manner allows operation of the web humidifier 237 to be controlled based on a predetermined duration stored in the storage section 282 without needing to make any complex calculations or the like, thereby enabling configuration of the control section 28 to be simplified.

This predetermined duration is one parameter affecting the humidification amount, and may be a preset duration, or may be a duration that changes dynamically based on various conditions and the like. Note that in consideration of securing the humidification amount while reducing downtime, the predetermined duration from the start to end of humidification by the web humidifier 237 is preferably from 5 minutes to 60 minutes, and is more preferably from 10 minutes to 40 minutes. When the duration of humidification by the web humidifier 237 is below the above lower limit, the humidification amount may be too low depending on the configuration of the second web M8, and so the moisture content of the second web M8 might not be sufficiently raised. When the humidification duration exceeds the above upper limit, the humidification amount may be too high depending on the configuration of the second web M8, and so issues such as the second web M8 sticking to the back face transport section 29 might arise.

After humidification of the second web M8 has stopped, the control section 28 recommences transportation of the second web M8 by the back face transport section 29. This also recommences manufacture of the second web M8.

As described above, the web manufacturing apparatus 1 according to the present embodiment includes the back face transport section 29, this being a transport section configured to transport the fiber-containing second web M8, the web humidifier 237 configured to humidify the second web M8, and the control section 28 configured to control operation of the back face transport section 29 and the web humidifier 237. When transportation of the second web M8 has stopped, the control section 28 recommences transportation of the second web M8 by the back face transport section 29 after the second web M8 has been humidified by the web humidifier 237.

In the web manufacturing apparatus 1, the second web M8 is transported in a state having sufficient mechanical properties, thereby suppressing a deterioration in the quality of the second web M8. This enables a high quality second web M8 to be manufactured, even after the web manufacturing apparatus 1 has been stopped and then started running again. Employing such a second web M8 ultimately enables a high quality sheet S to be manufactured.

Note that despite differing slightly according to the thickness and so on of the second web M8, the ratio by mass of the moisture content of the second web M8 after humidification is preferably no less than 3.5%, and is more preferably from 4.0% to 10.0%. When the moisture content is within this range, the second web M8 will have sufficient mechanical properties, while the generation of surplus moisture due to excessive moisture content is suppressed. This enables a second web M8 to be manufactured that in turn enables manufacture of a higher quality sheet S.

Note that the moisture content of the second web M8 may for example be measured using a paper moisture meter HK-300 manufactured by Kett Electric Laboratory.

Although transportation of the second web M8 recommences after humidification by the web humidifier 237 has stopped in the present embodiment, transportation may recommence prior to humidification by the web humidifier 237 stopping. Moreover, instead of the humidification duration, the control section 28 may control a humidification amount per unit of time, i.e. a humidification rate, or may control both the humidification duration and the humidification rate.

Although there is no particular limitation to the method of humidification by the web humidifier 237, a vaporizing humidifier device is preferably employed. A vaporizing humidifier device is less likely to generate large droplets, thereby enabling issues associated with droplets, such as only the surface of the second web M8 being humidified and the internal humidity level thereof not rising, to be suppressed. Furthermore, applying an airflow enables humidification to be performed over a comparatively wide range, enabling the second web M8 to be evenly humidified even when the second web M8 to be humidified has a large surface area. This enables the occurrence of creases or the like accompanying uneven humidification to be suppressed.

When the second web M8 is at a position where the second web M8 is more liable to dry out in the process, the web humidifier 237 is preferably provided close to this position. Specifically, in FIG. 2, as the second web M8 is transferred from the back face transport section 29 to the press section 201 of the sheet forming section 20, the second web M8 is in an unsupported state. The second web M8 is exposed to the air while in this unsupported state, which promotes drying of the second web M8. Thus, the space HS is preferably set so as to include an area between the back face transport section 29 and the press section 201, and placement of the web humidifier 237 is appropriately set such that the entire space HS is humidified, i.e. such that at least the second web M8 positioned between the back face transport section 29 and the press section 201 is humidified. This enables the moisture content of the second web M8 to be more reliably raised by humidification, and enables any deterioration in mechanical properties to be more reliably suppressed. This ultimately facilitates manufacture of a high quality sheet S using the sheet manufacturing apparatus 100.

Note that the area of the space HS between the back face transport section 29 and the press section 201 refers to the area between an upstream end of the back face transport section 29 and the press section 201. The space HS may be set so as to include an area between the disentangling section 18 and the back face transport section 29.

As described above, the sheet manufacturing apparatus 100 according to the present embodiment includes the web manufacturing apparatus 1 and the press section 201 that presses the second web M8 manufactured by the web manufacturing apparatus 1, and the sheet manufacturing apparatus 100 manufactures sheets S from the pressed second web M8.

This sheet manufacturing apparatus 100 enables a high quality second web M8 to be manufactured by the web manufacturing apparatus 1 even after the sheet manufacturing apparatus 100 has stopped and then started running again, thereby ultimately enabling a high quality sheet S to be manufactured.

Second Embodiment

Figure 5:
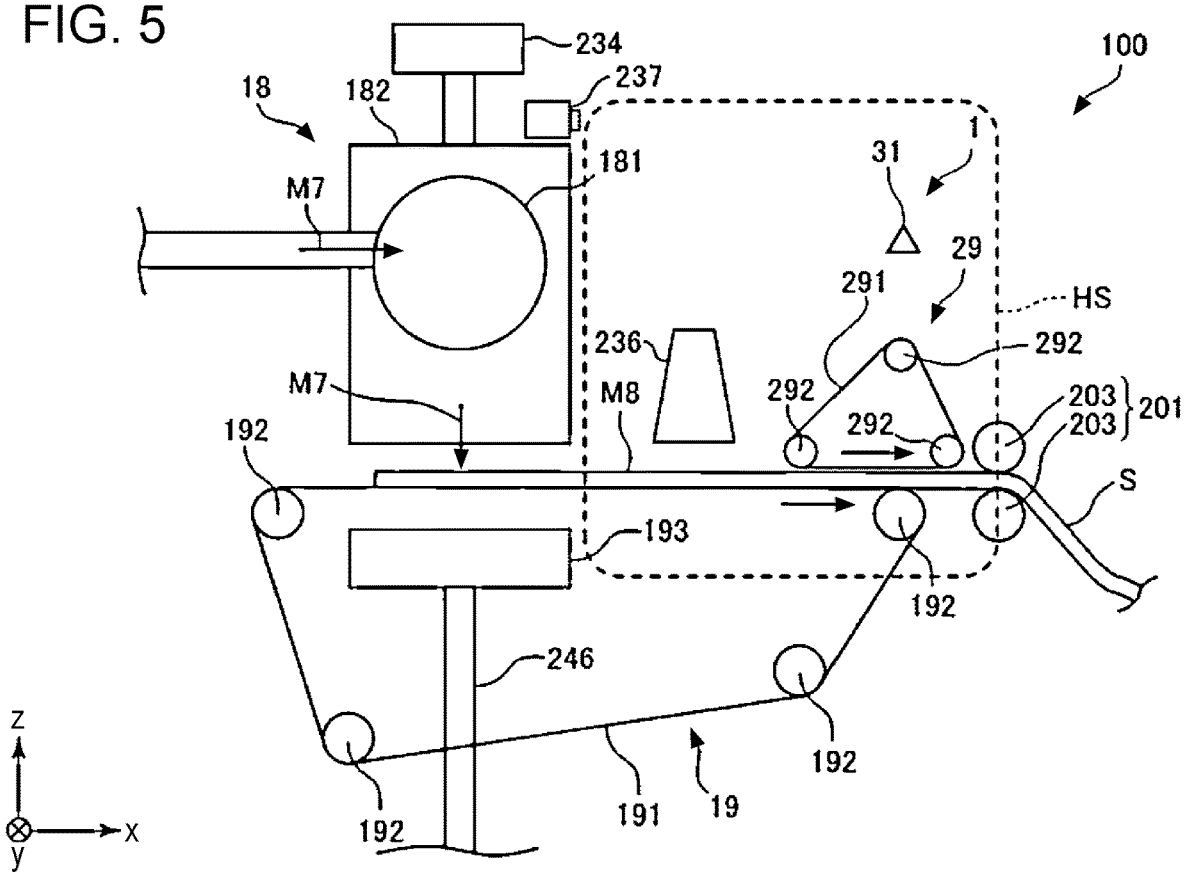
FIG. 5 is an enlarged view corresponding to part of a sheet manufacturing apparatus according to a second embodiment.
Figure 6:
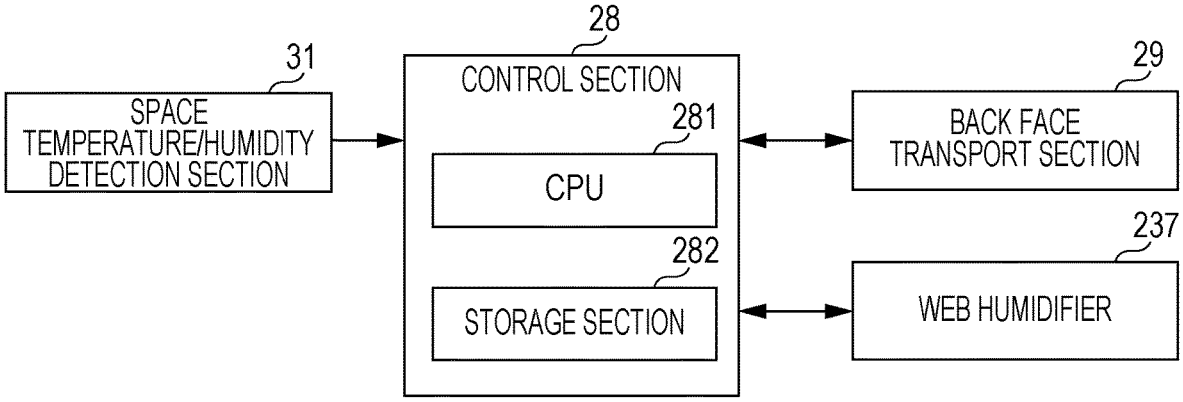
FIG. 6 is a block diagram of a web manufacturing apparatus according to the second embodiment.
Figure 7:
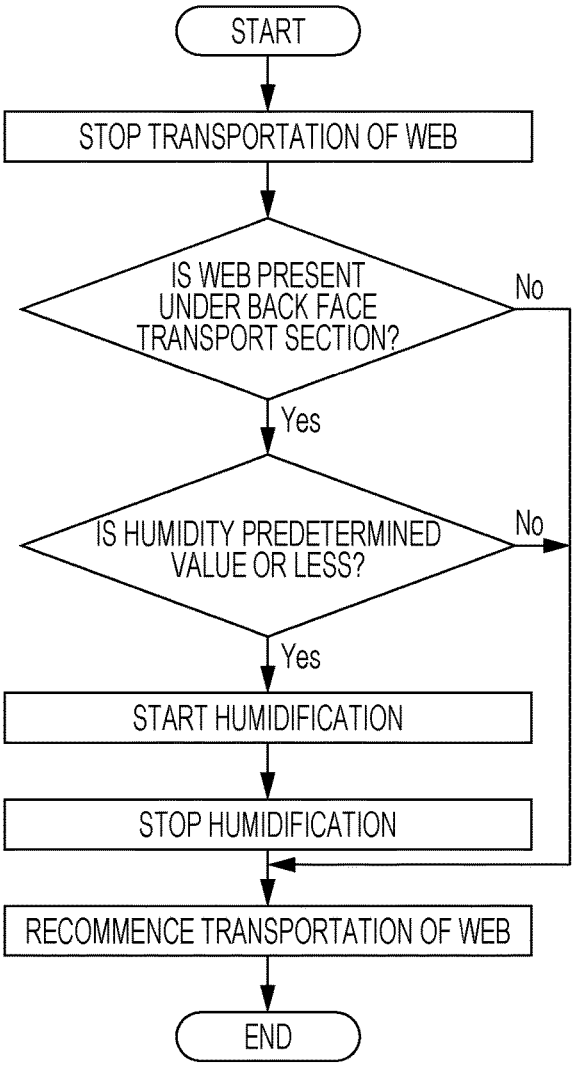
FIG. 7 is a flowchart illustrating operation of the web manufacturing apparatus illustrated in FIG. 6.

FIG. 5 is an enlarged view corresponding to part of a sheet manufacturing apparatus according to a second embodiment. FIG. 6 is a block diagram of a web manufacturing apparatus according to the second embodiment. FIG. 7 is a flowchart illustrating operation of the web manufacturing apparatus illustrated in FIG. 6.

Explanation follows regarding the second embodiment with reference to the drawings. The following explanation is focused on the differences to the embodiment described above, and explanation of similar matter thereto will be omitted. Note that configurations in the drawings that are similar to those in the embodiment described above are appended with the same reference numerals.

The present embodiment is similar to the first embodiment, except in that a control section controls operation of each section based on a detection result of a space temperature/humidity detection section.

In the first embodiment described above, control is performed such that after humidification of the second web M8 by the web humidifier 237 has started, humidification by the web humidifier 237 is stopped after a predetermined duration has elapsed. However, in the present embodiment, control is performed such that the humidification amount by the web humidifier 237 is adjusted based on the humidity in the space HS as detected by a space temperature/humidity detection section 31, this being a first humidity detection section. This enables the moisture content of the second web M8 to be optimized.

As illustrated in FIG. 5, a web manufacturing apparatus 1 according to the present embodiment includes the space temperature/humidity detection section 31 provided within the space HS in which the previously-described second web M8 is positioned. The space temperature/humidity detection section 31 detects the temperature and humidity within the space HS and outputs a detection result to the control section 28 as illustrated in FIG. 6.

Explanation follows regarding operation of the web manufacturing apparatus 1 according to the present embodiment based on the flowchart illustrated in FIG. 7.

When transportation of the second web M8 stops, the control section 28 stores information such as the humidity in the space HS as detected by the space temperature/humidity detection section 31, in addition to information such as the time of stopping and the presence or absence of the second web M8, in the storage section 282. Prior to transportation of the second web M8 recommencing, the control section 28 determines whether or not the second web M8 is present under the back face transport section 29.

When the second web M8 is not present under the back face transport section 29, preparation to recommence is complete, and so the control section 28 recommences transportation of the second web M8.

When the second web M8 is present under the back face transport section 29, the control section 28 performs determination based on the humidity in the space HS. Specifically, when the humidity in the space HS is higher than a predetermined value, determination is made that humidification is not required. The control section 28 recommences transportation of the second web M8 in such cases. Although the predetermined value for the humidity in the space HS on which this determination is based will differ according to the composition and so on of the second web M8, a relative humidity of 30% may be given as an example. Determination is made that humidification is not required when the relative humidity in the space HS is higher than 30%. Note that the predetermined value for the humidity in the space HS is not limited to a relative humidity of 30%, and may for example be any relative humidity from 20% to 50%.

When the humidity in the space HS is the predetermined value or below, determination is made that humidification is required. Namely, when the humidity detected by the space temperature/humidity detection section 31, this being a first humidity detection section, is the predetermined value or below, the control section 28 starts humidification of the second web M8 by the web humidifier 237. Determination as to whether or not humidification is required can be made based on a detected humidity value, without needing to make any calculation or the like, thereby enabling configuration of the control section 28 to be simplified.

The duration of humidification by the web humidifier 237 may be adjusted based on the humidity in the space HS as detected by the space temperature/humidity detection section 31. Namely, a relationship between the detected humidity, the humidification duration, and the moisture content may be acquired in advance, and the humidification duration computed based on this relationship so as to optimize the moisture content of the second web M8. This enables an increase in downtime due to excessive humidification to be suppressed, while optimizing the moisture content of the second web M8 and improving the mechanical properties of the second web M8. Note that when controlling the humidification amount, humidification may be performed for a computed humidification duration based on a detected humidity, or the humidity may be detected in real time and humidification performed while adjusting the humidification duration based on each detection result. As an example of control by the latter method, humidification is stopped at the point where the relative humidity in the space HS has reached from 40% to 60%. This enables insufficient humidification to be suppressed, and also enables time spent on unnecessary humidification to be shortened.

As described above, the web manufacturing apparatus 1 according to the present embodiment includes the space temperature/humidity detection section 31, this being a first humidity detection section that detects the humidity in the space HS in which the second web M8 is being transported, and the control section 28 controls operation of the web humidifier 237 based on the detection result of the space temperature/humidity detection section 31. This enables an increase in downtime due to excessive humidification to be suppressed, while optimizing the moisture content of the second web M8 and improving the mechanical properties of the second web M8.

Note that the storage section 282 may store information regarding the temperature of the space HS as detected by the space temperature/humidity detection section 31 if required. The control section 28 may also adjust the humidification duration while taking the temperature into account. When there is no need for temperature information, a space humidity detection section may be employed instead of a space temperature/humidity detection section.

A history of the humidity and temperature of the space HS after transportation of the second web M8 has stopped may also be stored in the storage section 282. Namely, the extent of the drop in the moisture content of the second web M8 after transportation has stopped may be estimated based on the history of the environment in which the second web M8 was present during the period between stopping and recommencing transportation of the second web M8. The control section 28 may therefore adjust the humidification amount accordingly based on the estimated extent of the drop in the moisture content so as to compensate for this drop. This enables the moisture content of the second web M8 to be particularly well-optimized during humidification, thereby enabling a particular contribution to be made to the manufacture of a high quality sheet S.

The timing at which humidification of the space HS is started may be the same as the timing at which the sheet manufacturing apparatus 100 starts running again, or may be earlier than this timing. For example, the timing of a task performed prior to the sheet manufacturing apparatus 100 starting to run again is an example of the latter method. Such a task may for example be a task of adding water for humidification, or adding feedstock M1.

Note that there is no particular limitation to the humidity detection method employed by the space temperature/humidity detection section 31, and for example a polymer resistance method or a polymer electrostatic capacitance method may be employed. Of these, a polymer resistance method is particularly preferable. A polymer resistance method enables accurate measurements even under high humidity and is structurally simple, and is therefore an effective method of humidity detection by the space temperature/humidity detection section 31.

Moreover, there is no particular limitation to the temperature detection method employed by the space temperature/humidity detection section 31, and for example a method employing a thermocouple, a resistance thermometer, a thermistor, or an infrared thermometer may be employed.

The second embodiment obtains similar advantageous effects to those in the first embodiment.

Third Embodiment

Figure 8:
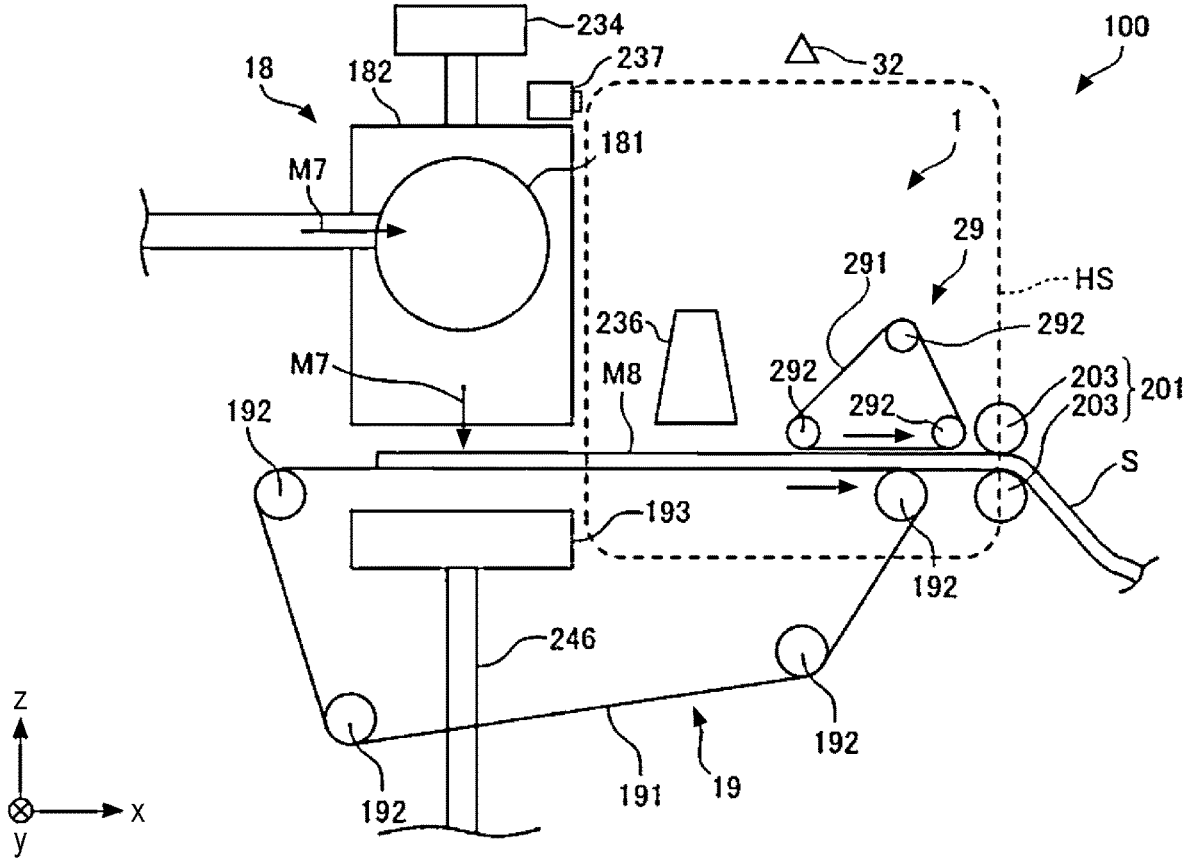
FIG. 8 is an enlarged view corresponding to part of a sheet manufacturing apparatus according to a third embodiment.
Figure 9:
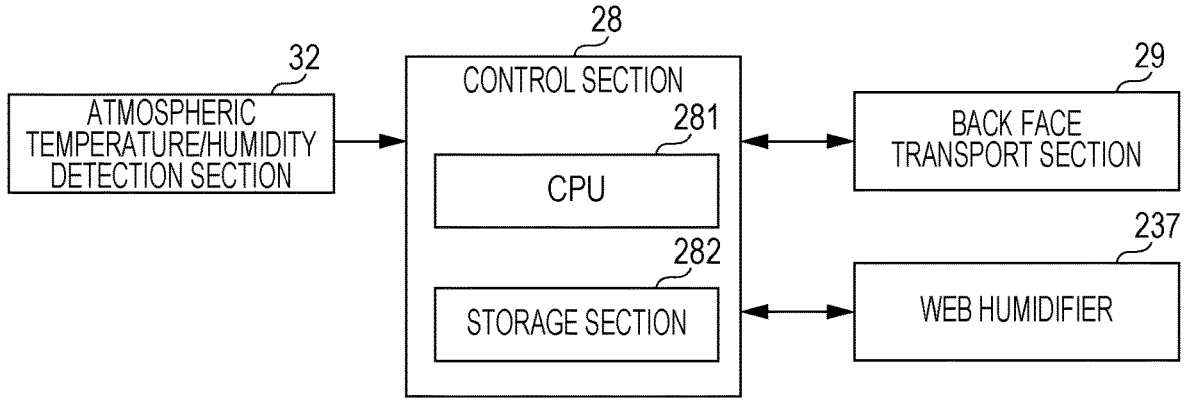
FIG. 9 is a block diagram of a web manufacturing apparatus according to the third embodiment.

FIG. 8 is an enlarged view corresponding to part of a sheet manufacturing apparatus according to a third embodiment. FIG. 9 is a block diagram of a web manufacturing apparatus according to the third embodiment.

Explanation follows regarding the third embodiment with reference to the drawings. The following explanation is focused on the differences to the embodiments described above, and explanation of similar matter thereto will be omitted. Note that configurations in the drawings that are similar to those in the embodiments described above are appended with the same reference numerals.

The present embodiment is similar to the second embodiment, except in that a control section controls operation of each section based on a detection result of an atmospheric temperature/humidity detection section.

In the second embodiment described above, control is performed so as to adjust the humidification amount based on the humidity in the space HS where the second web M8 is positioned. In the present embodiment, control is performed so as to adjust the humidification amount based on the atmospheric humidity around the sheet manufacturing apparatus 100.

As illustrated in FIG. 8, a web manufacturing apparatus 1 according to the present embodiment includes an atmospheric temperature/humidity detection section 32, serving as a second humidity detection section provided at a position enabling detection of the atmospheric humidity around the sheet manufacturing apparatus 100. The atmospheric temperature/humidity detection section 32 detects the atmospheric temperature and humidity and outputs a detection result to the control section 28 as illustrated in FIG. 9. The control section 28 then controls operation of the web humidifier 237 based on the detection result of the atmospheric temperature/humidity detection section 32. This enables an increase in downtime due to excessive humidification to be suppressed, while optimizing the moisture content of the second web M8 and improving the mechanical properties of the second web M8.

Note that it is sufficient for the atmospheric temperature/humidity detection section 32 to be installed at a position enabling detection of the atmospheric temperature and humidity. The atmospheric temperature/humidity detection section 32 may be provided at the outside of exterior panels of the sheet manufacturing apparatus 100, or may be provided at the inside of the exterior panels.

Explanation follows regarding operation of the web manufacturing apparatus 1 according to the present embodiment based on a flowchart. The flowchart is similar to the chart in FIG. 7 which refers to the second embodiment.

The control section 28 according to the present embodiment makes a determination based on the atmospheric humidity. Specifically, when the atmospheric humidity is higher than a predetermined value, the humidity inside the sheet manufacturing apparatus 100 is also deemed to be high, and determination is made that humidification by the web humidifier 237 is not required. The control section 28 recommences transportation of the second web M8 in such cases. Although the predetermined value for the atmospheric humidity on which this determination is based will differ according to the composition and so on of the second web M8, a relative humidity of 30% may be given as an example. Determination is made that humidification by the web humidifier 237 is not required when the relative atmospheric humidity is higher than 30%. Note that the predetermined value for atmospheric humidity is not limited to a relative humidity of 30%, and may for example be any relative humidity from 20% to 50%.

When the atmospheric humidity is the predetermined value or below, determination is made that humidification by the web humidifier 237 is required. The control section 28 starts humidification of the space HS by the web humidifier 237 in such cases.

The duration of humidification by the web humidifier 237 may be adjusted based on the atmospheric humidity as detected by the atmospheric temperature/humidity detection section 32. Namely, a relationship between the detected humidity, the humidification duration, and the moisture content may be acquired in advance, and the humidification duration calculated based on this relationship so as to optimize the moisture content of the second web M8. This enables an increase in downtime due to excessive humidification to be suppressed, while optimizing the moisture content of the second web M8 and improving the mechanical properties of the second web M8.

Note that the storage section 282 may store information regarding the atmospheric temperature as detected by the atmospheric temperature/humidity detection section 32 if required. The control section 28 may also adjust the humidification duration while taking the temperature into account. When there is no need for temperature information, an atmospheric humidity detection section may be employed instead of an atmospheric temperature/humidity detection section.

A history of the atmospheric humidity and temperature after transportation of the second web M8 has stopped may also be stored in the storage section 282. The extent of the drop in the moisture content of the second web M8 after transportation has stopped may be estimated based on this history. The control section 28 may adjust the humidification amount accordingly based on the estimated extent of the drop in the moisture content so as to compensate for this drop. This enables the moisture content of the second web M8 to be particularly well-optimized during humidification, thereby enabling a particular contribution to be made to the manufacture of a high quality sheet S.

The third embodiment obtains similar advantageous effects to those in the first and second embodiments.

Note that there is no particular limitation to the humidity detection method employed by the atmospheric temperature/humidity detection section 32, and for example a polymer resistance method or a polymer electrostatic capacitance method may be employed. Of these, the polymer resistance method is particularly preferable. The polymer resistance method enables accurate measurements even under high humidity and is structurally simple, and is therefore an effective method of humidity detection by the atmospheric temperature/humidity detection section 32.

Moreover, there is no particular limitation to the temperature detection method employed by the atmospheric temperature/humidity detection section 32, and for example a method employing a thermocouple, a resistance thermometer, a thermistor, or an infrared thermometer may be employed.

The third embodiment obtains similar advantageous effects to those in the second embodiment.

Note that the second embodiment and the third embodiment may be combined to configure a modified example. In such a case, the web manufacturing apparatus 1 includes both the space temperature/humidity detection section 31 and the atmospheric temperature/humidity detection section 32. The control section 28 is capable of adjusting the humidification amount based on information regarding the temperature and humidity in the space HS as detected by the space temperature/humidity detection section 31, and on information regarding the atmospheric temperature and humidity as detected by the atmospheric temperature/humidity detection section 32.

As an example, the web humidifier 237 according to the present modified example operates so as to humidify the second web M8 at a temperature at which the dew point of the space HS in which the second web M8 is being transported does not exceed the atmospheric temperature. Specifically, a humidifier device that vaporizes using air at room temperature rather than a warm airflow of heated air should be employed. By controlling the temperature during humidification in this manner, the difference between the temperature of the air discharged from the web humidifier 237 and the atmospheric temperature is reduced, enabling the formation of condensation accompanying humidification to be suppressed. Namely, this enables the formation of condensation due to the humidified air being cooled by the surrounding air and falling below the dew point, and any issues arising as a result thereof, to be suppressed. This enables the second web M8 to be manufactured in a more consistent manner.

Embodiments of a web manufacturing apparatus and a sheet manufacturing apparatus of the present disclosure have been explained above with reference to the drawings. However, the present disclosure is not limited to the above explanation, and each section configuring the web manufacturing apparatus and the sheet manufacturing apparatus may be replaced by a desired configuration capable of exhibiting similar functionality. Moreover, other configurations may be added as desired.

The web manufacturing apparatus and the sheet manufacturing apparatus of the present disclosure may also combine the configurations and characteristics of any two or more of the above embodiments.

Although the web humidifier 237 for humidifying the space HS is provided in each of the above embodiments, the functionality of the web humidifier 237 may be implemented by the humidifier 234 or the humidifier 236. Namely, the web humidifier 237 may be omitted, with the space HS being humidified by the humidifier 234 or the humidifier 236 instead.

EXAMPLES

Explanation follows regarding specific examples of the present disclosure.

1. Web Manufacture

Example 1

A second web M8 was manufactured directly before reaching a press section using the web manufacturing apparatus illustrated in FIG. 1 and FIG. 2.

The second web M8 was then left under a back face transport section for a full day at an atmospheric temperature of 10° C. and a relative atmospheric humidity of 15%.

The following day, the second web M8 was humidified for 25 minutes by a web humidifier prior to restarting the web manufacturing apparatus. The second web M8 was extracted in this state as a humidified web.

Note that the space in which the second web M8 was disposed had a relative humidity of 60% following humidification.

Examples 2, 3

Humidified webs similar to that of Example 1 except for having differing thicknesses and the like were obtained.

Comparative Examples 1 to 3

With the exception that humidification was not performed, non-humidified webs otherwise similar to those in Examples 1 to 3 were obtained.

2. Web Evaluation 2.1. Moisture Content Measurement

The moisture content of each of the obtained webs was measured using a paper moisture meter (HK-300 manufactured by Kett Electric Laboratory). The measurement results are given in Table 1.

2.2. Tensile Load Measurement

First, each of the obtained webs was pressed and stretched into sheet form, then cut into a predetermined shape and a test piece obtained.

The obtained test piece was then set in a tensile load tester, and the tensile load at break was measured.

The obtained measurement values were then evaluated using the below evaluation criteria.

Tensile Load Evaluation Criteria

A: Tensile load of 2N or greater

B: Tensile load of less than 2N

The evaluation results are given in Table 1.

TABLE 1

| | Property | Unit | Example 1 | Example 2 | Example 3 | Comparative example 1 | Comparative example 2 | Comparative example 3 |
|---|---|---|---|---|---|---|---|---|
| Manufacturing conditions | Paper thickness | μm | 100 | 97 | 97 | 112 | 121 | 132 |
| | Basis weight | $g/m^2$ | 88.4 | 87.2 | 87.2 | 93.0 | 94.6 | 94.6 |
| | Density | $g/cm^3$ | 0.89 | 0.90 | 0.90 | 0.83 | 0.78 | 0.71 |
| Evaluation result | Moisture content | % | 4.50 | 5.00 | 5.50 | 2.90 | 2.80 | 2.90 |
| | Load | — | A | A | A | B | B | B |

As is clear from Table 1, the webs obtained in each of the Examples had high moisture content and withstood sufficiently high tensile load. In contrast thereto, the webs obtained in each of the Comparative Examples had low moisture content and withstood insufficient tensile load.

The above examples confirm that humidification raises the moisture content of the web and is thus capable of enhancing the mechanical properties.

What is claimed is:

1. An apparatus for use in web manufacturing, the apparatus comprising:

a belt configured to transport a web containing fiber;

a web humidifier configured to humidify the web; and a controller configured to, in order, stop the belt, cause the web humidifier to humidify the web, and start the belt.

2. The apparatus for use in web manufacturing according to claim 1, wherein the controller is configured to cause the web humidifier to stop humidification of the web after the web humidifier starts humidification of the web and a predetermined duration elapses.

3. The apparatus for use in web manufacturing according to claim 1, further comprising a first humidity sensor configured to detect humidity in a space in which the web is transported, wherein the controller is configured to control operation of the web humidifier based on a detection result of the first humidity sensor.

4. The apparatus for use in web manufacturing according to claim 3, wherein the controller is configured to cause the web humidifier to humidify the web when the humidity detected by the first humidity sensor is a predetermined value or below.

5. The apparatus for use in web manufacturing according to claim 1, further comprising a second humidity sensor configured to detect atmospheric humidity, wherein the controller is configured to control operation of the web humidifier based on a detection result of the second humidity sensor.

6. The apparatus for use in web manufacturing according to claim 1, wherein the web humidifier includes a vaporizing humidifier device.

7. The apparatus for use in web manufacturing according to claim 1, wherein the web humidifier is configured to humidify the web at a temperature at which a dew point of a space in which the web is transported does not exceed an atmospheric temperature.

8. A sheet manufacturing apparatus configured to manufacture a sheet from a web which is pressed, the sheet manufacturing apparatus comprising:

the apparatus for use in web manufacturing according to claim 1; and a press configured to press the web humidified by the web humidifier.

9. The sheet manufacturing apparatus according to claim 8, wherein the web humidifier is configured to humidify the web at least positioned between the belt and the press.

* * * * *